US005224302A

United States Patent [19]

Grossi

[11] Patent Number: 5,224,302

[45] Date of Patent: Jul. 6, 1993

[54] DEVICE FOR RE-CONDITIONING CUTTING ELEMENTS OF DISPOSABLE DOUBLE-BLADE SHAVERS

[76] Inventor: Alfredo Grossi, 675 Montes de Oca Ave., Buenos Aires, Argentina, 1270

[21] Appl. No.: 857,589

[22] Filed: Mar. 25, 1992

[30] Foreign Application Priority Data

Apr. 19, 1991 [AR] Argentina ..... 319.490

[51] Int. Cl.[5] ..... B24B 33/00

[52] U.S. Cl. ..... 51/204; 51/158; 51/211 H; 51/214

[58] Field of Search ..... 51/204, 205 R, 211 R, 51/211 H, 205 WG, 214, 285, 158

[56] References Cited

U.S. PATENT DOCUMENTS 5,036,731 8/1991 Fletcher ..... 51/211 H

FOREIGN PATENT DOCUMENTS 131369 11/1962 Argentina .

*Primary Examiner*—Bruce M. Kisliuk
*Assistant Examiner*—Eileen P. Morgan
*Attorney, Agent, or Firm*—Keck, Mahin & Cate

[57] ABSTRACT

A device for re-conditioning the cutting elements of disposable double-blade shavers includes a supporting structure having guides for directing manual sharpening of the blades. The device also includes abrasive elastic material portions fixed to the structure. Reconditioning of the blades is obtained by providing friction between the blades and the sharpening surfaces.

13 Claims, 1 Drawing Sheet

DEVICE FOR RE-CONDITIONING CUTTING ELEMENTS OF DISPOSABLE DOUBLE-BLADE SHAVERS

FIELD OF THE INVENTION

The instant invention relates to a device for settling and re-sharpening disposable double-blade shavers in a simple and economical way.

The disposable nature of such elements, the use of which is widespread, which constitute an outstanding improvement as compared to conventional exchangeable blade devices, is limited since the cutting elements may be used only for a few days or a slightly longer period of time.

It is known that, commonly, the user of disposable shavers does not use them any more once the blades have lost their cutting capability, or when the final result of shaving is unsatisfactory.

It is also known that the above circumstance often takes place at times, situations or places wherein a new shaver may not be acquired, which is extremely uncomfortable if the user has no replacement shaver.

Further, despite the cost of each disposable unit being considerably lower than that of former disposable shavers, in the case of people having low incomes, the economy involved in the prolonged use of a disposable shaver is significant.

The above disadvantages are overcome by the instant device, which may settle and re-sharpen, easily, quickly and almost indefinitely, the disposable shaver by the use of the device of the invention, which is of simple construction, very small size, light weight and very low cost.

PRIOR ART

At present, devices for treating blades of disposable double-blade shavers are not known. As already known, such blades are firmly mounted on a structure, at fixed distances and angles, which makes their sharpening difficult.

To the best of my knowledge, the only device which could be mentioned as being relevant prior art is that of Argentine Patent No. 131,369, already expired, disclosing a device for sharpening interchangeable old shaving blades. However, the structure, the mechanical features and the way of use of this device are completely different from those of the instant invention.

The device of Argentine patent 131,369 comprises a supporting base having a series of aligned parallel rollers for guiding a loose leather strip which is held, by means provided for this purpose, facing the blade to be sharpened at each pass. The passage of the blade is carried out by pulling the leading end of the leather strip, the blade being previously fixed at the proper position by means provided to the effect, secured to the supporting base.

The limited scope of the above device, its complex construction and cumbersome use, make evident the advantages of the instant device and the novelty thereof. The only common feature of both devices is the universal way of re-sharpening blades, which is performed by proper friction against an abrasive surface.

The invention will be now described in connection with an exemplary embodiment thereof which in no way is intended is to limit scope of the invention.

DETAILED DESCRIPTION OF THE INVENTION

Figure 1:
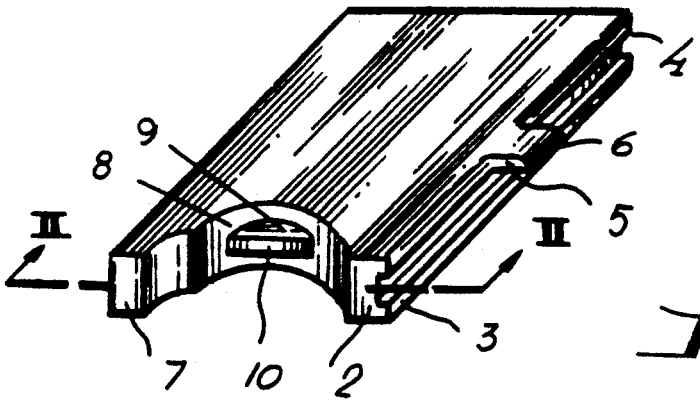
FIG. 1 is a perspective schematic view of the device of the settling and re-sharpening device of the invention.

FIG. 1 shows a schematic perspective view of an embodiment including a structure T having the shape of a rectangular parallelepiped, which may be made of plastic, rubber or any other material of similar mechanical strength. Injected plastic is the preferred material for cost considerations.

The general size of the parallelepiped may be about 40 mm length, 27 mm width and 5 mm thickness.

The structure has, along one of its longer sides 2, a flange 3 and along the opposide edge, a similar flange 4. The latter has, at its middle point, a planar lug 5, which is thin and relatively flexible, having at its free end a convex tapering 6. The surface of the lug is smoothly abrasive; this is accomplished by spraying or brushing, before the plastic injection, the area corresponding to the die with a proper abrasive powder, which will become automatically included in the plastic surface upon injection.

The parallelepiped also has a substantially circular notch or cavity 8 at another of its sides, towards the interior of the structure, its gap being partially interrupted by a relatively resilient thin plane 9 solidly connected to the walls thereof, and having a free edge 10, relatively parallel to edge 7, said edge having abrassive properties similar to those of the surface of the lug 5.

The flanges 3 and 4, along with the planar side 2, as well as the inner walls of cavity 8, form guides for the displacement of the abrasive surfaces 6 and 10 when operated on the cutting edges when the device is used.

The best results when treating the cutting edges are obtained when, after settling and sharpening one of the blade faces, the almost negligible burr produced at the opposite face is removed.

The device of the invention provides means for settling and sharpening the cutting edge; therefore, for settling or sharpening, the abrasive surface 9 of the edge of cavity 8 is used, and for removing burrs at the opposite plane, abrassive surface 6 of lug 5 is used.

The way of operating the device will be hereinafter described in connection with FIGS. 1, 2, 3, 4 and 5.

Figure 2:
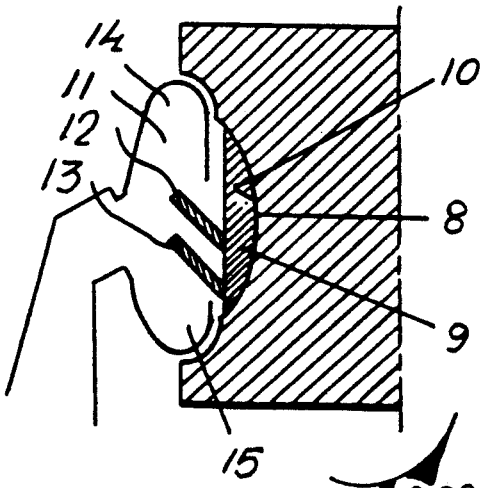
FIG. 2 is a cross section taken along line II—II of FIG. 1 applied to a shaver, from which a cross section of its head is also shown.

FIG. 2 includes a cross section of the shaver head 11, and the corresponding part of the sharpening device, showing the way in which the elastic abrasive plane 10 should be contacted with blades 12 and 13. The curved ends of cavity 8 are simultaneously, fitted on upper and lower limits 14 and 15 of the shaver front part.

Figure 3:
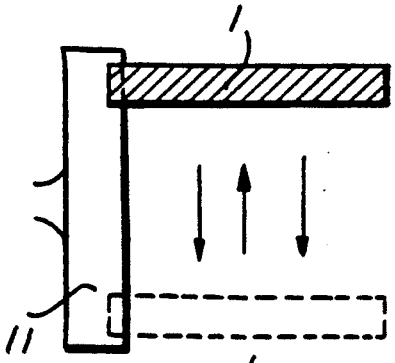
FIG. 3 is a view of the position to be adopted by the user with respect to the front of the shaver, also indicating the relative movement to be made for attaining the desired purpose.

FIG. 3 shows schematically the perpendicular position in which the sharpening device should be held with respect to the front of shaver 11. The arrows show the alternating shifting directions towards the ends of the shaver, taking care to maintain the pressure of plane 10 on blades 12 and 13.

Figure 4:
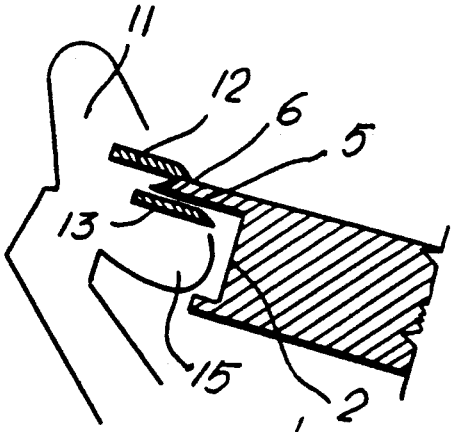
FIG. 4 shows the way in which burrs are removed after the operation shown in FIG. 3.

FIG. 4 shows schematically the way in which burrs are removed. The abrasive elastic lug 5 should be introduced such that, in each case for each blade, the abrasive convex surface 6 contacts the lower part of blades 12 or 13, taking care that plane 2 bears along the lower edge 15 of the front part of the shaver.

Figure 5:
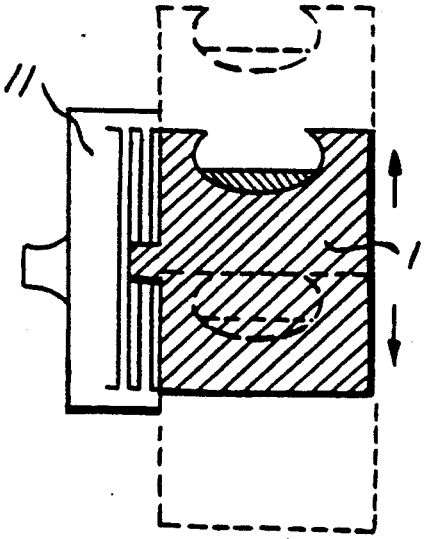
FIG. 5 is a schematic view showing the way in which the device of the invention contacts the shaver head in order to complete settling of the cutting edges.

FIG. 5 shows schematically the way in which the device is contacted with the shaver head after inserting lug 5. The arrows show the alternating shifting directions towards the ends, thus completing treatment of the cutting edges.

Both operations are repeated until sharpening of the blades is completed.

It is also to be noted that, due to the particular constitution of the sharpening elements, the above operations may be carried out either in a dry state or with the shaver wet, and even under tap water, which allows excellent cleaning of the shaver, removing any remaining soap and hair normally adhering to the blades, thus contributing to excellent shaving.

I claim:

1. A device for reconditioning a shaver, said shaver including at least one blade affixed to and projecting at a predetermined angle from a front part of a head of a structure of said shaver, said at least one blade comprising a pair of opposite faces meeting at a cutting edge to be resharpened, said device comprising:

a body structure having at least a first side having a first shaver guide means for guiding the shaver and a second side having a second shaver guide means for guiding the shaver;

sharpening means, associated with said first guide means, for sharpening one face of said at least one blade of the shaver during at least one to-and-fro movement of said head along said first guide means; and means, associated with said second guide means, for removing burrs from an opposite face of said at least one blade during a sliding movement of said head along said second guide means.

2. A device as claimed in claim 1, wherein said body structure comprises a rectangular parallelepiped body.

3. A device as claimed in claim 2, wherein said parallelepiped body is generally flat so as to define four side faces, the first and second sides comprising a respective one of said side faces.

4. A device as claimed in claim 1, wherein said structure is made of injected plastic.

5. A device as claimed in claim 1, wherein said first shaver guide means comprises a notch traversing said first side.

6. A device as claimed in claim 5, wherein said sharpening means comprises an abrasive surface inside said notch.

7. A device as claimed in claim 6, wherein said sharpening means comprises a resilient plate element including a free edge transverse relative to the direction of said to-and-fro movement and said abrasive surface covers said free edge.

8. A device as claimed in claim 5, wherein said notch has curved ends for fitting on to said front part.

9. A device as claimed in claim 1, wherein said second shaver guide means comprises a pair of parallel flanges extending along opposite edges of said second side.

10. A device as claimed in claim 9, wherein said means for removing burrs comprises a lug projecting from the middle of one of said flanges, said lug having an abrasive surface for contacting said opposite face while said head is moved in contact with said second guide means.

11. A device as claimed in claim 1, wherein said means for removing burrs comprises a lug having an abrasive surface for contacting said opposite face during said sliding movement.

12. A device as claimed in claim 11, wherein said abrasive surface on the lug is convex.

13. A device as claimed in claim 1, wherein a pair of parallel blades is provided and said sharpening means is adapted to sharpen one face of each of said blades simultaneously during said to-and-fro movement.

* * * * *